US006022395A

United States Patent [19]

Eckert et al.

[11] Patent Number: 6,022,395

[45] Date of Patent: Feb. 8, 2000

[54] METHOD FOR INCREASING TAP DENSITY OF MOLYBDENUM POWDER

[75] Inventors: Jeffrey A. Eckert, Tunkhannock; David C. Sheppeck, Sayre; James N. Christini, Towanda; Thomas R. Pinkowski, Sayre, all of Pa.

[73] Assignee: Osram Sylvania Inc., Danvers, Mass.

[21] Appl. No.: 09/046,706

[22] Filed: Mar. 24, 1998

[51] Int. Cl.[7] ..... B22F 9/22

[52] U.S. Cl. ..... 75/365; 75/369; 75/371

[58] Field of Search ..... 75/364, 365, 369, 75/370, 371

[56] References Cited

U.S. PATENT DOCUMENTS

| | | | |
|---|---|---|---|
| 3,053,614 | 9/1962 | Foos et al. | 75/365 |
| 4,079,116 | 3/1978 | Ronzio et al. | 423/56 |
| 4,547,220 | 10/1985 | Carpenter et al. | 75/84 |
| 5,173,108 | 12/1992 | Houck | 75/370 |
| 5,734,960 | 3/1998 | Patrician et al. | 75/369 |
| 5,785,731 | 7/1998 | Fait et al. | 75/371 |

FOREIGN PATENT DOCUMENTS

| | | | |
|---|---|---|---|
| 60-221538 | 11/1985 | Japan | 75/364 |
| 516467 | 6/1976 | U.S.S.R. | 75/369 |

*Primary Examiner*—George Wyszomierski
*Attorney, Agent, or Firm*—Robert F. Clark

[57] ABSTRACT

A method is provided for producing molybdenum metal powders having consistently high tap densities. The method involves doping an ammonium molybdate solution with a soluble potassium compound, forming an ammonium dimolybdate precipitate and reducing the precipitate to form a metal powder.

7 Claims, No Drawings

METHOD FOR INCREASING TAP DENSITY OF MOLYBDENUM POWDER

TECHNICAL FIELD

This invention relates to the manufacture of molybdenum powders. More particularly, this invention relates to manufacturing molybdenum powders having an increased tap density.

BACKGROUND ART

Refractory metal powders are commonly processed into useful articles by conventional powder metallurgical techniques. For example, powder metallurgical techniques are used routinely in the production of molybdenum ingots for use in the manufacture of molybdenum wire. A typical process involves filling a mold having the desired shape with a molybdenum powder and applying pressure to form a compact. The compact is then sintered in a separate operation to form a densified ingot. In such a process, it is desirable that the molybdenum powders exhibit a consistently high tap density in order to maximize production efficiency and minimize cost. A consistent tap density permits the use of a fixed mold size eliminating the need to adjust molds according to the variation in the tap density. Furthermore, high tap densities allow the molds to be used with minimal tamping. As a result, variations in the size and weight of the molybdenum ingots are minimized. Thus, it would be advantageous to have a method for making molybdenum powders having consistently high tap densities.

SUMMARY OF THE INVENTION

It is an object of the invention to obviate the disadvantages of the prior art.

It is another object of the invention to provide a method for making molybdenum metal powders having consistently high tap densities.

It is further object of the invention that the particle size of the molybdenum powder not be substantially changed in order to increase the tap density.

In accordance with one object the invention, there is provided a method for increasing the tap density of molybdenum powder. The method comprises adding an amount of a soluble potassium compound to an ammonium molybdate solution, forming an ammonium dimolybdate precipitate and reducing the ammonium dimolybdate precipitate to form a molybdenum metal powder.

In accordance with another object of the invention, the particle size of the molybdenum metal powder produced by the method is no greater than the particle size of a molybdenum metal powder made by a similar method without adding the soluble potassium compound.

DESCRIPTION OF THE PREFERRED EMBODIMENTS

For a better understanding of the present invention, together with other and further objects, advantages and capabilities thereof, reference is made to the following disclosure and appended claims.

A general method for producing molybdenum powders involves reducing ammonium dimolybdate (ADM) to brown molybdenum oxide ($MoO_2$) in a calciner at between 600 to 700° C. followed by reduction of the brown oxide to the metal in a muffle furnace at between 1000–1100° C. in a hydrogen atmosphere. Such a process is described in U.S. Pat. No. 4,547,220 to Carpenter et al. which is herein incorporated by reference. It is preferred that the molybdenum powder used to form molybdenum ingots for wire making have a high tap density, preferably greater than 3.5 g/cm$^3$, in order to consistently produce ingots of the desired weight.

Prior attempts aimed at increasing the tap density of molybdenum powders focused on increasing the particle size distribution of the powders. As a general rule, powders having larger average particle sizes have lower surface areas (m$^2$/g); lower surface areas translate into reduced interparticle friction allowing particles to pack more tightly; and tighter packing is manifested in higher tap densities. However, while in at least in one case these attempts produced higher tap densities, the amount of variation in the tap density proved unacceptable. Thus, another method was sought which would not only increase the tap density of the powder but do it consistently.

It was discovered that doping the ammonium dimolybdate crystals with potassium produced molybdenum powders having consistently high tap densities. In fact, contrary to the prior attempts, the increased tap densities were achieved without a concomitant increase in particle size or an increase the amount of potassium in the molybdenum powder. The latter result is considered especially advantageous since there was concern that doping the ADM crystals with potassium would produce an unacceptable increase in the amount of potassium in the metal powder. Higher potassium levels in the molybdenum powder could be harmful to molybdenum wire made from the powder as potassium can affect the recrystallization temperature of the molybdenum and thereby change the physical characteristics of the wire. Although varied amounts of potassium had been observed historically in ADM lots, including up to about 50 ppm K, no attempt had been made to increase or maintain the level of potassium because of its potential detrimental effects. Thus, the purposeful addition of potassium to the ADM starting material ran counter to conventional wisdom.

In a method of this invention, the ADM crystals are doped by adding an amount of a soluble potassium compound such as potassium hydroxide to an ammonium molybdate solution prior to crystallization. It is preferred that amount of potassium added be sufficient to increase the concentration of potassium in the crystallized ADM to at least about 30 ppm and preferably from about 30 to about 300 ppm. More preferably, the range of potassium concentrations in the ADM should be from about 30 to about 100 ppm with a more preferred value being about 50 ppm. The potassium doped ammonium molybdate solution is then evaporated and the ADM crystals precipitate as the solution cools to room temperature. An example of a general method for producing ADM is given U.S. Pat. No. 4,079,116 which is incorporated herein by reference. The potassium doped ADM is then converted into molybdenum powder as described above.

Tap densities were consistently increased from about 3.2 g/cm$^3$ to about 3.7 g/cm$^3$. The particle size of the molybdenum powders remained about 3.5 $\mu$m as measured by Fisher Sub-Sieve Sizer (FSSS). This size is typical for powders produced by the same process without doping the ADM with potassium. Examples of molybdenum powders lots made with potassium doped ADM are shown in Table 1. Tap densities were measured according to standard method ASTM B 527.

TABLE 1

| Mo Powder Lot No. | ADM K conc. (ppm) | Mo Metal K conc. (ppm) | Tap Density ($g/cm^3$) | FSSS ($\mu m$) | Porosity |
|---|---|---|---|---|---|
| 12 | 90 | 21 | 3.6 | 3.5 | 0.633 |
| 24 | 86 | 20 | 3.7 | 3.67 | 0.608 |
| 25 | 61 | 21 | 3.88 | 3.64 | 0.610 |
| 39 | 100 | 22 | 3.7 | 3.59 | 0.616 |
| 33 | 44 | 19 | 3.77 | 3.73 | 0.636 |
| 32 | 41 | 25 | 3.7 | 3.3 | 0.650 |
| 34 | 61 | 22 | 3.74 | 3.66 | 0.613 |
| 40 | 41 | 20 | 3.7 | 3.43 | 0.634 |
| 41 | 57 | 22 | 3.85 | 3.42 | 0.624 |

As can be seen in Table 1, the amount of potassium in the doped ADM ranges from 41 to 100 ppm whereas the amount of potassium in the molybdenum metal powder ranges from 19 to 25 ppm. Typically, the level of potassium in molybdenum metal powders made from undoped ADM is about 20 ppm. Thus, the data in Table 1 confirms that the added potassium in the ADM is being removed during the conversion of the doped ADM to molybdenum metal.

Data taken over an extended period determined that the average tap density for 21 separate lots of molybdenum metal powder made from potassium doped ADM was $3.74 \pm 0.09$ $g/cm^3$, a variation of about ±2% in the tap density. In comparison, data from 38 lots of molybdenum metal powder made from undoped ADM revealed an average tap density of $3.4 \pm 0.4$ $g/cm^3$, a variation of about ±12% in the tap density. The variation of no greater than about ±2% in the tap density means that not only is the tap density increased by the method of this invention, but it is also done so consistently.

Further analysis of the data reveals that the tap density is more closely related to porosity than with particle size. The correlation coefficient for FSSS particle size vs. tap density was observed to be −0.0892 whereas the correlation coefficient for porosity vs. tap density was found to be −0.876. Thus, a decrease in the porosity brings about an increase in the tap density. Lots having a porosity of 0.650 or lower had a tap density of greater than 3.5 $g/cm^3$ and lots having a porosity greater than 0.650 had a tap density lower than 3.5 $g/cm^3$.

While there has been shown and described what are at the present considered the preferred embodiments of the invention, it will be obvious to those skilled in the art that various changes and modifications may be made therein without departing from the scope of the invention as defined by the appended claims.

We claim:

1. A method for increasing the tap density of molybdenum powder comprising:

adding an amount of a soluble potassium compound to an ammonium molybdate solution;

forming an ammonium dimolybdate precipitate, the ammonium dimolybdate precipitate having a potassium concentration of from about 30 ppm to about 300 ppm; and reducing the ammonium dimolybdate precipitate to form a molybdenum metal powder.

2. The method of claim 1 wherein potassium concentration is from about 30 to about 100 ppm.

3. The method of claim 2 wherein the potassium concentration is about 50 ppm.

4. The method of claim 2 wherein the tap density of the molybdenum metal powder is greater than 3.5 $g/cm^3$.

5. The method of claim 4 wherein the variation in the tap density is no greater than about ±2%.

6. The method of claim 2 wherein the particle size of the molybdenum metal powder is no greater than the particle size of a molybdenum metal powder made by a method substantially identical to that as set forth in claim 1 but without said step of adding the soluble potassium compound.

7. The method of claim 1 wherein the soluble potassium compound is potassium hydroxide.

* * * * *